US006139426A

United States Patent [19]

Koerber

[11] Patent Number: 6,139,426

[45] Date of Patent: Oct. 31, 2000

[54] MOLDED POLYMER AIR DIFFUSING SCREEN

[75] Inventor: Keith G. Koerber, Goffstown, N.H.

[73] Assignee: Chemfab Corporation, Merrimack, N.H.

[21] Appl. No.: 09/037,470

[22] Filed: Mar. 10, 1998

Related U.S. Application Data

[63] Continuation-in-part of application No. 08/975,430, Nov. 20, 1997, which is a continuation-in-part of application No. 08/590,102, Jan. 24, 1996, Pat. No. 5,725,427.

[51] Int. Cl.[7] ..... F24F 13/068

[52] U.S. Cl. ..... 454/296; 454/284; 454/906

[58] Field of Search ..... 454/284, 296, 454/297, 298, DIG. 906; 181/224

[56] References Cited

U.S. PATENT DOCUMENTS

| | | | |
|---|---|---|---|
| 2,172,944 | 9/1939 | Norris | 454/296 X |
| 2,329,102 | 9/1943 | Chipley | 454/296 X |
| 3,058,411 | 10/1962 | Hanson et al. | 454/296 |
| 3,084,609 | 4/1963 | Onstad | 454/296 |
| 5,207,614 | 5/1993 | Passadore | 454/298 |

*Primary Examiner*—Harold Joyce
*Attorney, Agent, or Firm*—White & Case LLP

[57] ABSTRACT

A molded plastic air diffusing screen in an air supply system provided for effectively diffusing or deflecting air supplied through a coreless or vane-free duct such that undesirable air turbulence and draft/currents are substantially diminished; more particularly, the novel plastic screen diffuser minimizes noise emanating from the penetrating air supply.

24 Claims, 5 Drawing Sheets

MOLDED POLYMER AIR DIFFUSING SCREEN

This application is a continuation-in-part of application Ser. No. 08/975,430 filed Nov. 20, 1997 which is a continuation-in-part of application Ser. No. 08/590,102 filed Jan. 24, 1996 (U.S. Pat. No. 5,725,427).

FIELD OF THE INVENTION

The invention relates to an air diffusing system for environmental control applications in commercial and residential buildings; or more particularly to an air diffusing screen made of molded non-textile material wherein the opening perforation are appropriately sized, shaped and numerous so as to effect a diffusion of air supply thereby avoiding or minimizing the "dumping" effect which causes air turbulence in an environment so supplied.

BACKGROUND OF THE INVENTION

Air diffusing systems are designed to redirect air which is supplied from a duct in the ceiling of the enclosed environment. Prior solutions are directed to screen made from fabric material. By contrast, the inventive method is directed air diffuser made of molded tight mesh.

In general, it has been known that air diffusers redirect air as it flows into a room from a ceiling mounted supply duct. Without a diffuser, the air provided by the duct will flow straight down into the room. This can cause undesirable air drafts or turbulence within the room.

The prior art diffusers solve this and other problems by redirecting and diffusing the air as it enters the room. To accomplish this goal, the exit "face" of a typical prior art diffuser has a group of angled vanes or louvers. In addition, directional devices may be found inside the duct above or behind the outlet portion of the system.

Prior art diffusers that utilize angled vanes include those set forth in U.S. Pat. No. 3,948,155, issued Apr. 6, 1976 (Warren R. Hedrick), U.S. Pat. No. 4,266,470, issued May 12, 1981 (Schroeder et al.), U.S. Pat. No. 4,366,748, issued Jan. 4, 1983 (Wilson et al.), U.S. Pat. No. 5,054,379, issued Oct. 8, 1991 (Franc Sodec), U.S. Pat. No. 5,192,348, issued Mar. 9, 1993 (Craig S. Ludwig), and U.S. Pat. No. 5,454,756, issued Oct. 3, 1995 (Craig S. Ludwig).

Fabric sheets have been used in diffuser systems to filter dust and other particulate matter from the air passing into the room. U.S. Pat. No. 4,603,618, issued Aug. 5, 1986 (Charles W. Soltis), discloses a clean room ventilation system having a fabric sheet fixed above a perforated ceiling grid. The fabric sheet filters the air and provides a uniform laminar flow of air into the room. The fabric sheet and perforated grid extend across the entire ceiling, and air flows from the ceiling straight down into the room.

The prior art air diffusers have many problems. They often accumulate dust, which tends to build up around the angled vanes. In addition, the prior art air-handling systems tend to be noisy.

Fabrics have also been used to absorb sound. U.S. Pat. No. 4,152,474, issued May 1, 1979 (Cook, deceased et al.), discloses an acoustic absorber which comprises a substrate having a plurality of openings. An organic polymer coating covers the substrate and partially fills the openings in the substrate.

Prior to the present invention a method has been discovered for diffusing air flowing from an air supply duct. The method included using an open-weave fabric sheet for changing the air flow from a vertical to a lateral direction and velocity after exit from the sheet, mounting the fabric sheet in a holding frame, and installing the frame-sheet assembly at the exit portion of the duct.

However, there are drawbacks in the use of fabric based air diffusing systems. First, the surface of the fabric screen is manufactured in batch lots such that the flexibility is curtailed as size, shape, density, and aperture shape, dimension, and number. Moreover, there are difficulties in the biaxial stretching by tensioning the fabric within the holding frame. It is also difficult to permanently color or stain such a fabric diffusing screen in the small lots.

It is the object of this invention to provide an air diffusing system which overcomes the disadvantages or complications of the fabric-based prior art by balancing air flow and air passage, through the diffusing screen, thus controlling air supply and distribution into an enclosed environment along the ceiling so as to reduce or eliminate direct downward air drafts or turbulence.

Another object of this invention is directed to a significant reduction in noise usually associated with the passage of air through a diffusion system, particularly as produced by the angled vane type diffusers.

SUMMARY OF THE INVENTION

The present invention is directed to an air diffusion system comprising a molded plastic air diffusing screen installed at the end of an air duct controllably supplying air to an enclosed environment, such as a room or hall.

The present invention is preferably directed to a plastic molded screen which has an array of numerous openings or perforations occupying about 60% of the molded screen area, more preferably about 50% of the molded screen area or most preferably about 35% of the molded screen area.

Similar to the situation with the copending fabric diffusing system (Ser. No. 08/975,430), the degree of lateral deflection depends on flow rate, opening size and molded screen thickness. According to the invention, the screen is molded by compression, thus forming a frontal face and a rear face which preferably are used as the entry and the exit surface, respectively.

Furthermore, the molding polymer is a thermoplastic and can be treated to be dust repellent and soil and corrosion resistant. A thin coating layer with these attributes as has been found advantageous in the case of fabric screens can be applied to the molded diffuser screen.

Certain surface treatments are applied to reduce accumulation of particulate matter as well as frequency and expense of cleaning.

A molded article also can be used to laterally redirect the flow of air coming into one face and exiting the other. Again, the air flowing from the duct into the molded sheet or screen is angularly deflected and radially flows away from the "center" of the exit face—in the same pattern as described in the copending patent application Ser. No. 08/975,430. The externally supplied diffused air and the "standing" room air in front of the exit face collide and mix and flow parallel and flow radially outward. It should be noted that for this described phenomenon to occur, the molded sheet must be of a unique aperture configuration, and one not unlike the textile described in the original filing. This invention provides multiple advantages in the realm of air diffusers as well as other potential applications. Instead of tensioning the fabric as in the original filing, the molded face is planar as a function of molding. It can also have back side ribbing to maintain its flat sun face. If a contoured face was desired for a different distribution pattern, this form could be more easily accomplished. The rigid frame can be an integral part of the sun face in a compression molded assembly. It is the intent of this invention to achieve the lateral direction change and radial pattern for air flowing from a supply duct perpendicularly, exiting from the planar screen surface.

DETAILED DESCRIPTION OF THE PREFERRED EMBODIMENT

Figure 1:
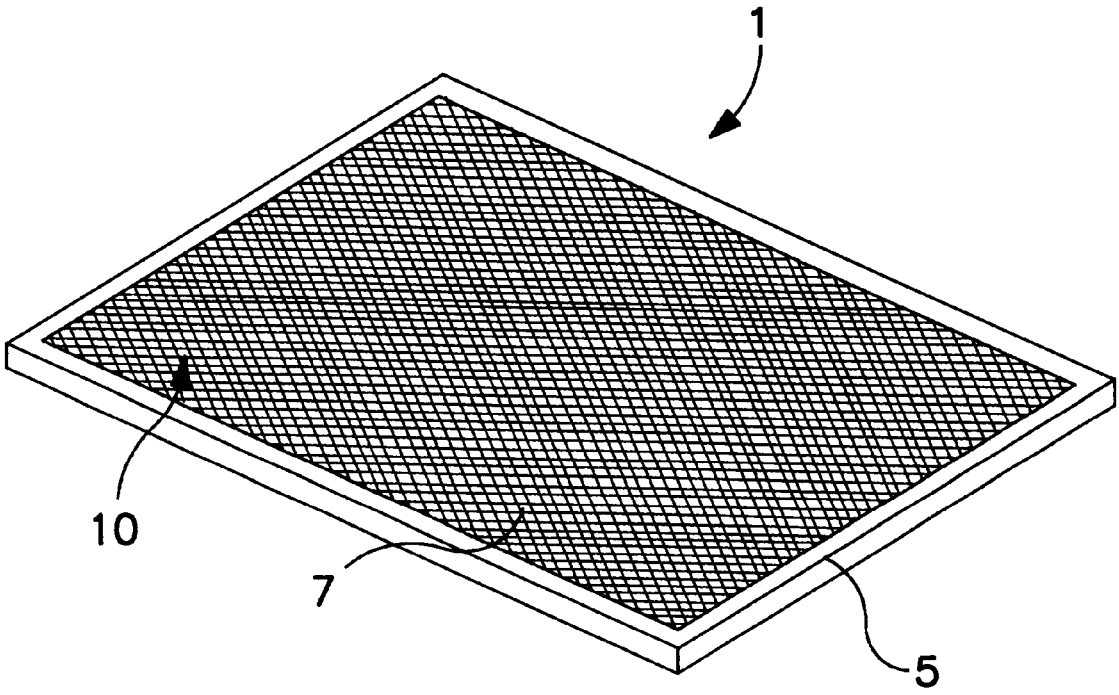
FIG. 1 is a perspective view of the molded air diffuser of the present invention.

Referring to FIG. 1., in the preferred embodiment, the molded plastic screen diffuser 1 of the invention comprises a rectangular frame 5 adapted to be connected to the end of a typical air supply duct. Mounted within the rectangular frame is a flat, thin molded polymer sheet having a plurality of elliptical holes. Antistatic compounds as are known in the plastics art can be incorporated in the polymeric composition of the plastic molded diffusing screen so as to prevent dust or particle buildup on the top side of the screen and maintain an open area for the air flow to pass through. The molded plastic screen can be mounted in the frame. Alternatively, the plastic screen and frame assembly can be molded as one monolithic unit. This molding step can be achieved by heating and compressing the thermoplastic assembly.

The frame or both frame and screen can be reinforced by fibers known to be suitable for stabilizing thermoplastic materials. For example, the use of carbon fiber or glass fiber technology offers a simple way to integrate light-weight fiber as reinforcement for the molded diffuser screen frame assembly.

The molded screen may also be coated by soil-resistant material. Thus a substantial open area is maintained in the sheet. The soil-resistant material is preferably a fluoropolymer, such as polytetrafluoroethylene (PTFE), although other low surface energy polymers, such as fluoropolymers, may be employed.

The troublesome effects of static charging is a surface phenomenon. Chemical additives such as antistatic reagents ("antistats") can remedy the static buildup. External antistats, such as glycerine or polyglycols, can be applied to the surface of the molded plastic screen usually by spraying or by dipping the screen or screen-frame assembly into a dilute (0.1% to 2.0%) solution of the antistatic in water or alcohol. A more permanent antistatic protection is effected by incorporating antistat into the surface layer of the molded plastic at 1–2%.

Chemical antistats are usually also surfactants, which may be cationic, anionic or non-ionic compounds, as known in the art.

Non-ionic antistats are preferred in the inventive embodiments as they have low polarity which aids in their compatibility with plastics such as olefins and others. Moreover, non-ionic antistats are not irritating when released in the air.

Non-ionic internal antistats range from 0.05 to 2.5% which range is suitable for polypropylene, provided the molding temperature do not exceed the stability of the antistatic compound such as the preferred ethoxylated tertiary amine which is particularly efficient in low humidity environments.

Forming the thermoplastic composites, reinforced or plain, into diffusing screens involves a stamping or fast compression molding operation. Reinforcement by glass fiber ranges from 25 to 50 wt-%.

Carbon fiber reinforcement can be accomplished by incorporating continuous filament, non-twist yarns and tows with preferred counts of filaments in the low thousands of the intermediate modules variety of chopped fibers as are generally available.

Figure 2:
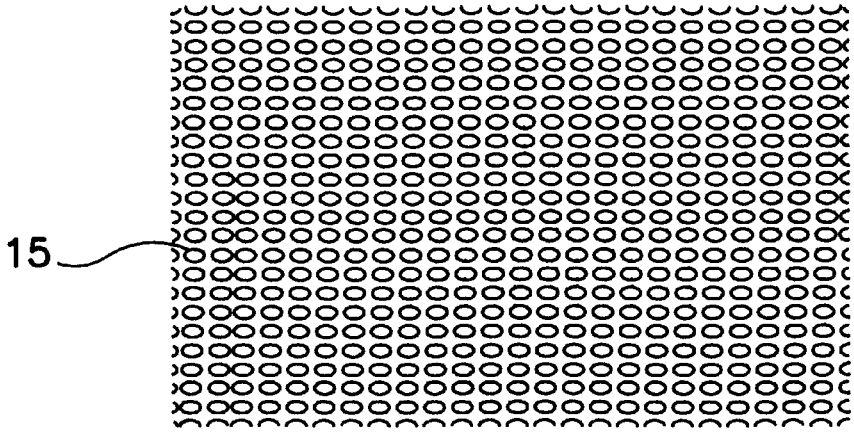
FIG. 2 is a top-view of the molded polymer screen used in the present invention.

Referring to FIG. 2, the molded plastic ribs are aligned cross-over pattern. Each perforation is formed by fine ribbing 15. The preferred plastic is polypropylene. The thicknesses, of the molded screen are approximately 0.030 inches, preferably 0.026 inches or more preferably 0.020 inches. After compression, the cross-sectional shape of the perforation is oval. The size of the perforation may range from 0.085 to 0.0170 inches depending on the screen thickness.

Figure 3:
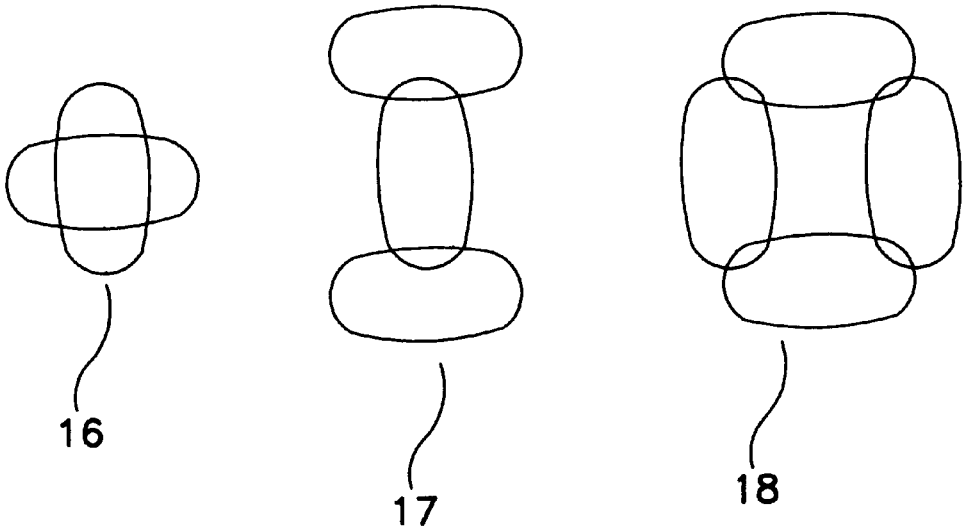
FIG. 3 is a magnified top-view of the three preferred open configurations illustrating a preferred 2-ply molded plastic screen assembly wherein two screens are superimposed at a 90° rotation.

Another preferred embodiment of the invention is a 2-ply screen frame assembly wherein the screens are either superimposed at the same alignment or superimposed after a 90° rotation with respect to each other. FIG. 3 illustrates the three main shapes formed by the superimposed perforations. The overlapping areas 16–18 are shown. The perforation of the superimposed screens can be of equal or different size. If different, the larger perforation is preferably placed above the smaller one.

The molded screen has openings which are essentially rectangular or oval in plane. The total open area can range approximately from 60 to 30% of the area of the screen. The dimensions given for the molded screen are operable for air volumes and pressures associated with conventional air-handling systems. The dimensions of the screen may vary, however, depending on the volume and pressure of the air flowing into the fabric and the amount of deflection desired.

Figure 4:
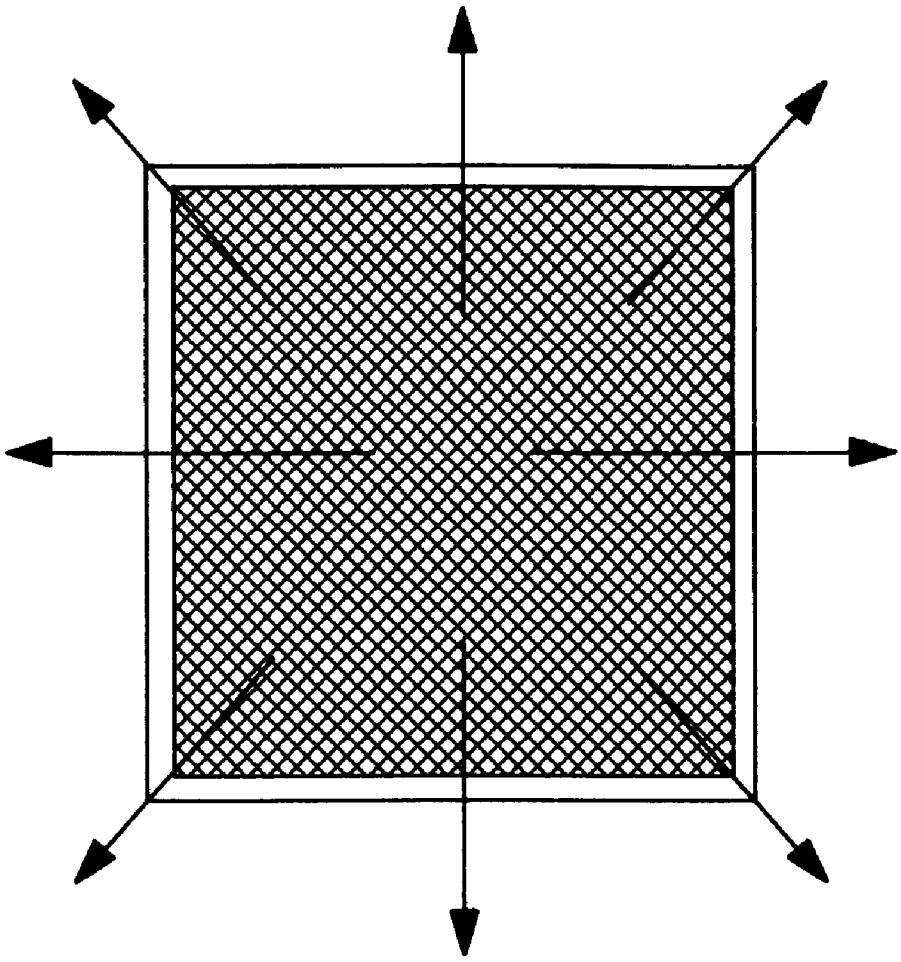
FIG. 4, which is a bottom view of the diffuser mounted on an air supply duct, shows the air exiting the sheet radially in all directions.

In FIG. 4, the general direction of air flow propagation is denoted by arrows. While a number of factors, such as back pressure caused by the diffuser and the shape of the particular air duct, may cause a variation in the direction of air flow at any one given point within the duct 30, the general direction of air propagation is downwardly into the diffuser sheet. The molded diffuser screen changes the direction of air propagation as the air exits the screen. The redirected air flows laterally to the screen, and flows radially outward in all directions, as shown by the arrows in FIG. 4 (a bottom view). This redirection causes the air to hug the ceiling or wall depending on the placement of the particular diffuser and supply duct. While in the preferred embodiment the air exiting the openings flows laterally to the sheet and radially outward, it is envisioned that sheets of varying types and dimensions can be employed to deflect air in other patterns. Also, while in the more preferred embodiment the molded plastic screen is a flat configuration, it is envisioned that the sheet maybe employed in a curved formation, for example, by thermoforming it into a dish-shaped configuration.

Figure 5A:
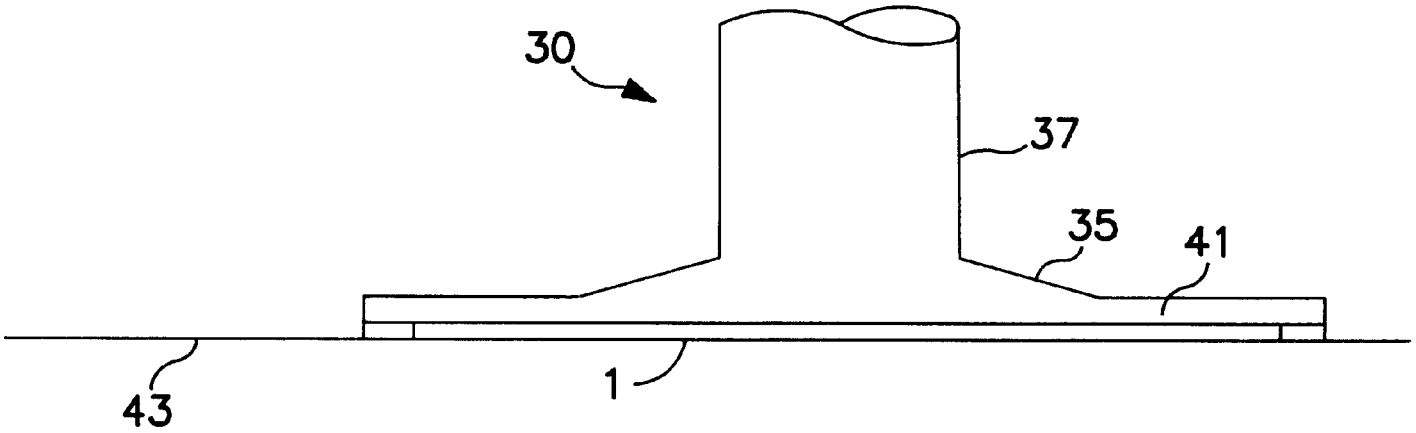
FIG. 5*a* and 5*b* show side and perspective views of an air duct having a tapered portion extending into a rectangular cavity.
Figure 5B:
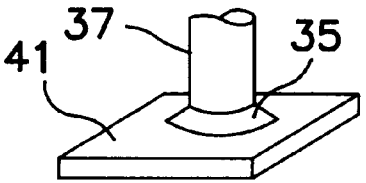

The air diffuser of the invention has been used successfully to redirect air propagating from air ducts of a number of different shapes and sizes. For example, FIGS. 5*a* and 5*b* show a duct 30 having a cylindrical air supplyway 37 extending into a tapered portion 35 which further extends into an open-face rectangular cavity 41. The rectangular cavity 41 is disposed flush over a cut-away portion in the ceiling 43. The diffuser 1 is mounted over the open face of the rectangular cavity 41. Typical dimensions for the duct include a 6" diameter cylindrical supplyway 37 extending into a rectangular cavity having equal side lengths of 21" and a height of 0.5". Upon testing, it was found that as air passed through the diffuser 1, the air flowed laterally from the diffuser and radially outward in all directions, as shown in FIG. 5 above, respectively.

Figure 6:
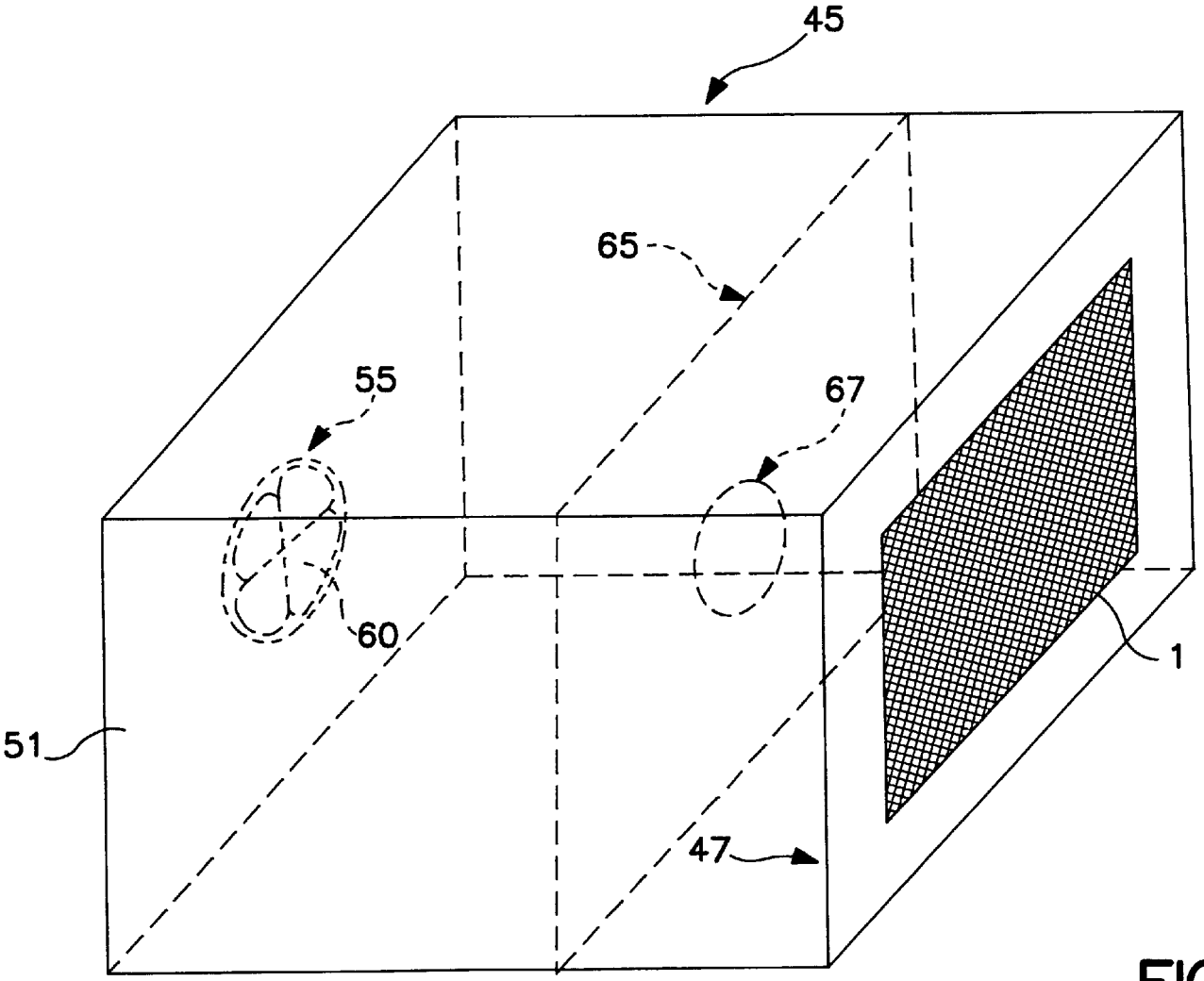
FIG. 6 shows a perspective view of an experimental air duct system.

The molded plastic air diffuser has also been tested in an experimental duct system shown in FIG. 6. In the experiment, a rectangular box 45 having a length of 17", height of 10.5", and depth of 12.75" was made with an open end 47 and closed end 51 having a circular opening 55 approximately 4" in diameter. The diffuser 1 (constructed with the appropriate dimensions) was mounted over the open end 47, and a 4" fan 60 was mounted in circular opening 55. The baffle 65 having a 3" circular opening 67 was disposed across the center of the box 45. The baffle 60 was used to create a variation in the pressure distribution of air on the interior of the box 45. At a number of different fan speeds, it was observed that air exiting the diffuser 1 would flow laterally to the diffuser and radially outward as it exited the diffuser 1.

EXAMPLE 1

A molded plastic screen diffuser was tested in three different configurations. The first screen was of thickness of approximately 0.030 inches, the second approximately 0.026 inches, and the third approximately 0.020 inches. The axis approximate axial dimensions of the perforated openings for the three thicknesses tested were as follows:

about 0.165 to 0.170 inches along the major axis and about 0.110 to 0.118 inches and 0.120 inches along the minor axis at about 0.030 inches' thickness; about 0.155 to 0.160 inches along the major axis and about 0.095 to 0.100 inches along the minor axis at about 0.026 inches thickness; and about 0.150 to 0.155 inches along the major axis and about 0.085 to 0.095 along the minor axis at about 0.020 inches thickness. In terms of open area, the calculated values were approximately 53%, 44% and 39% for the 0.030 inch, 0.026 inch and 0.020 inch thick screens, respectively.

An efficient deflection of the air flow through the molded screen assembly was observed. Specifically, the 0.020 inch configuration was effective in deflecting an air flow of 650 cfm (cubic feet per minute). The larger perforations were also effective, depending on the air flow pressure or velocity.

What is claimed is:

1. A plastic air diffuser for an air supply duct which is devoid of an internal steering or deflecting device, the diffuser comprising:

a molded sheet having an array of perforations so as to form a screen for redirecting the flow of air upon exiting the sheet to flow laterally to and radially outward from the sheet upon passage from an air supply duct;

the sheet being assembled with a frame for holding and securing to an outlet of the air supply duct.

2. The plastic air diffuser of claim 1, wherein the perforation array occupies 60% of the screen area.

3. The plastic air diffuser of claim 1, wherein the perforation array occupies 50% of the screen area.

4. The plastic air diffuser of claim 1, wherein the perforation array occupies 40% of the screen area.

5. The plastic air diffuser of claim 1, wherein the perforation array occupies 30% of the screen area.

6. The plastic air diffuser of claim 1, wherein the plastic of the molded sheet comprises a thermoplastic polymer composition.

7. The plastic air diffuser of claim 1, wherein the plastic sheet ranges from 0.020 to 0.030 inches in thickness.

8. The plastic air diffuser of claim 1, wherein the perforations are rectangular with rounded corners or oval in shape.

9. The plastic air diffuser of claim 1, wherein the perforations are oval in shape and are approximately 0.085 to 0.120 inches in diameter along the minor axis and approximately 0.150 to 0.170 inches along the major axis.

10. The plastic air diffuser of claim 1, wherein the perforations are oval in shape and are approximately 0.085 to 0.095 inches at the minor axis and 0.150 to 0.155 inches at the major axis when the screen is about 0.020 inches thick.

11. An air diffusion system comprising a sheet composed of at least one plastic screen having an array of perforations, said sheet held in a frame for mounting to an air supply duct outlet; the duct being devoid of internal deflectors or steering devices and wherein the sheet redirects the flow of air upon exiting the sheet to flow laterally to and radially outward from the sheet.

12. The air diffusion system of claim 11, wherein the screen is constructed of molded thermoplastic material.

13. The air diffusion system of claim 11, wherein the perforations have average size of approximately 0.085 to 0.0118 inches along the minor axis and 0.150 to 0.170 inches along the major axis, when the thickness of the screen ranges from 0.020 to 0.030 inches.

14. The air diffusion system of claim 11, wherein the plastic screen is reinforced by a sheet of ribbing.

15. The air diffusion system of claim 11, wherein air passes from the air duct through the sheet assembly at predetermined velocity or pressure so as to substantially change flow velocity and direction upon exiting from the screen area.

16. The air diffusion system of claim 11, wherein the molded plastic screen reduces the noise of the air supply.

17. An air diffuser system comprising:

an air supply duct which is devoid of an internal steering or deflecting device;

a plastic air diffuser composed of a molded sheet having an array of perforations so as to form a screen for redirecting the flow of air upon exiting the sheet to flow laterally to and radially outward from the sheet upon passage from the air supply duct; and a frame supporting the diffuser, the frame secured to an outlet of the air supply duct.

18. An air diffuser system according to claim 17, wherein the molded sheet has a thickness in the range of about 0.020–0.030 inches and the perforation array occupies 30–60% of the sheet area.

19. An air diffuser system according to claim 18, wherein the molded sheet has a thickness of about 0.020 inches and the perforation array occupies 39% of the sheet area.

20. An air diffuser system according to claim 19, wherein the perforations are approximately 0.085 to 0.095 inches at the minor axis and 0.150 to 0.155 inches at the major axis.

21. An air diffuser system according to claim 18, wherein the molded sheet has a thickness of about 0.026 inches and the perforation array occupies 44% of the sheet area.

22. An air diffuser system according to claim 21, wherein the perforations are approximately 0.095 to 0.100 inches at the minor axis and 0.155 to 0.160 inches at the major axis.

23. An air diffuser system according to claim 18, wherein the molded sheet has a thickness of about 0.030 inches and the perforation array occupies 53% of the sheet area.

24. An air diffuser system according to claim 23, wherein the perforations are approximately 0.110 to 0.120 inches at the minor axis and 0.165 to 0.170 inches at the major axis.

* * * * *